US008907853B2

(12) United States Patent
Ying

(10) Patent No.: US 8,907,853 B2
(45) Date of Patent: Dec. 9, 2014

(54) WIRELESS ELECTRONIC DEVICES WITH MULTIPLE CURVED ANTENNAS ALONG AN END PORTION, AND RELATED ANTENNA SYSTEMS

(75) Inventor: Zhinong Ying, Lund (SE)

(73) Assignees: Sony Corporation, Tokyo (JP); Sony Mobile Communications AB, Lund (SE)

( * ) Notice: Subject to any disclaimer, the term of this patent is extended or adjusted under 35 U.S.C. 154(b) by 250 days.

(21) Appl. No.: 13/559,018

(22) Filed: Jul. 26, 2012

(65) Prior Publication Data

US 2014/0028525 A1 Jan. 30, 2014

(51) Int. Cl.
*H01Q 1/24* (2006.01)
*H01Q 1/52* (2006.01)

(52) U.S. Cl.
CPC ..... *H01Q 1/243* (2013.01); *H01Q 1/521* (2013.01)
USPC ..... 343/702; 343/893

(58) Field of Classification Search
CPC ..... H01Q 1/243; H01Q 1/521; H01Q 9/42
USPC ..... 343/702, 893, 846
See application file for complete search history.

(56) References Cited

U.S. PATENT DOCUMENTS

| | | | | |
|---|---|---|---|---|
| 2009/0058738 | A1 | 3/2009 | Sakuma et al. | |
| 2010/0220016 | A1 * | 9/2010 | Nissinen et al. | 343/702 |
| 2010/0304785 | A1 | 12/2010 | Marlett et al. | |
| 2012/0092221 | A1 * | 4/2012 | Schlub et al. | 343/702 |
| 2013/0002510 | A1 * | 1/2013 | Azulay et al. | 343/860 |

FOREIGN PATENT DOCUMENTS

WO WO 2011/101851 A1 8/2011

OTHER PUBLICATIONS

Extended European Search Report Corresponding to European Application No. 13171287.9-1812; Dated: Nov. 6, 2013; 7 Pages.

* cited by examiner

*Primary Examiner* — Hoanganh Le
(74) *Attorney, Agent, or Firm* — Myers Bigel Sibley & Sajovec, PA

(57) ABSTRACT

Wireless electronic devices may include a backplate and first and second curved antennas spaced apart from each other along an end portion of the backplate. Each of the first and second curved antennas may include a radiating element and a parasitic element electrically coupled to the radiating element. Related systems are also described.

20 Claims, 10 Drawing Sheets

WIRELESS ELECTRONIC DEVICES WITH MULTIPLE CURVED ANTENNAS ALONG AN END PORTION, AND RELATED ANTENNA SYSTEMS

FIELD

The present inventive concepts generally relate to the field of communications and, more particularly, to antennas and wireless electronic devices incorporating the same.

BACKGROUND

Wireless terminals may operate in multiple frequency bands (i.e., "multi-band") to provide operations in multiple communications systems. For example, Long Term Evolution (LTE) Multiple-Input and Multiple-Output (MIMO) cellular radiotelephones may be designed for operation in nominal frequency bands such as 700-800 Megahertz (MHz), 824-894 MHz, 880-960 MHz, 1710-1850 MHz, 1820-1990 MHz, 1920-2170 MHz, and 2500-2700 MHz.

Achieving effective performance in multiple frequency bands may be difficult. For example, contemporary wireless terminals are increasingly including more circuitry and larger displays and keypads/keyboards within small housings. Constraints on the available space and locations for antennas in wireless terminals can negatively affect antenna performance.

For example, although wireless terminals may include multiple antennas, mutual coupling between different antennas may degrade performance. Moreover, if a wireless terminal uses its chassis as a shared radiator for multiple antennas operating in low frequency bands (e.g., below about one (1.0) Gigahertz (GHz)), then mutual coupling may particularly degrade performance (e.g., in terms of correlation, diversity gain, and capacity) in the low frequency bands.

SUMMARY

Various embodiments of the present inventive concepts include wireless electronic devices. The wireless electronic devices may include a backplate. The wireless electronic devices may additionally include first and second curved antennas spaced apart from each other along an end portion of the backplate. Each of the first and second curved antennas may include a radiating element and a parasitic element electrically coupled to the radiating element.

In various embodiments, each parasitic element may include a respective partial metal ring that extends adjacent a perimeter of the backplate from the end portion of the backplate to a respective side portion of the backplate.

According to various embodiments, the wireless electronic devices may further include a multi-band transceiver circuit coupled to the first and second curved antennas and configured to provide communications for the wireless electronic devices via a plurality of frequency bands. A distance between each partial metal ring and the multi-band transceiver circuit may be greater than a distance between each radiating element and the multi-band transceiver circuit.

In various embodiments, each partial metal ring may be on a respective dielectric frame that is between the partial metal ring and the backplate.

According to various embodiments, each dielectric frame may include at least one of plastic, glass, and ceramic materials.

In various embodiments, each of the first and second curved antennas may extend along a majority of the respective side portion of the backplate.

According to various embodiments, each of the first and second curved antennas may be grounded adjacent the respective side portion of the backplate.

In various embodiments, the first and second curved antennas may be spaced apart from each other along the end portion of the backplate to provide a gap between the first and second curved antennas of about 8.0 millimeters.

According to various embodiments, the wireless electronic devices may further include a connector in the gap that is configured to provide at least one of power, audio, video, and Universal Serial Bus (USB) connections.

In various embodiments, the wireless electronic devices may further include a third antenna on another end portion of the backplate.

According to various embodiments, the third antenna may include at least one of a curved antenna, a cellular antenna, a non-cellular antenna, a diversity antenna, and a C-fed monopole metal antenna.

In various embodiments, the wireless electronic devices may further include a gap that separates the third antenna from the backplate and the first and second curved antennas.

According to various embodiments, the third antenna may include a cellular antenna. Additionally, the first and second curved antennas may include a non-cellular antenna and a cellular antenna, respectively.

In various embodiments, the third antenna may include a non-cellular antenna, and the first and second curved antennas may include respective cellular antennas.

According to various embodiments, the first, second, and third antennas may include respective partial metal ring antennas.

In various embodiments, the backplate may include a metal backplate.

Wireless electronic devices according to various embodiments may include a backplate on a multi-band transceiver circuit configured to provide communications for the wireless electronic devices via a plurality of frequency bands. The wireless electronic devices may also include first and second curved antennas spaced apart from each other along an end portion of the backplate. Each of the first and second curved antennas may include a radiating element and a parasitic element electrically coupled to the radiating element. The multi-band transceiver circuit may be configured to communicate through the first and second curved antennas via the plurality of frequency bands. Also, each parasitic element may include a respective partial metal ring that extends from the end portion of the backplate to a respective side portion of the backplate. Furthermore, each of the first and second curved antennas may extend along a majority of the respective side portion of the backplate.

In various embodiments, each of the first and second curved antennas may be grounded adjacent the respective side portion of the backplate.

Multi-band antenna systems according to various embodiments may include a backplate including a perimeter that includes first and second end portions and first and second side portions. The multi-band antenna systems may also include first and second metal curved antennas spaced apart from each other along the first end portion of the backplate. Each of the first and second metal curved antennas may include respective first and second radiating elements electrically coupled to respective first and second metal curved parasitic elements. The first and second metal curved parasitic elements may extend continuously adjacent the perimeter from the end portion of the backplate along the first and second side portions of the backplate, respectively.

In various embodiments, the multi-band antenna systems may further include a third antenna on the second end portion of the backplate. The first and second metal curved antennas may be grounded adjacent the respective first and second side portions of the backplate. Also, the third antenna may include a monopole antenna. Furthermore, the first and second curved antennas may include a non-cellular antenna and a cellular antenna, respectively. Additionally, the first and second metal curved parasitic elements may extend continuously adjacent the perimeter from the end portion of the backplate along a majority of the first and second side portions of the backplate, respectively.

Other devices and/or systems according to embodiments of the inventive concepts will be or become apparent to one with skill in the art upon review of the following drawings and detailed description. It is intended that all such additional devices and/or systems be included within this description, be within the scope of the present inventive concepts, and be protected by the accompanying claims. Moreover, it is intended that all embodiments disclosed herein can be implemented separately or combined in any way and/or combination.

DETAILED DESCRIPTION OF EMBODIMENTS

Figure 1:
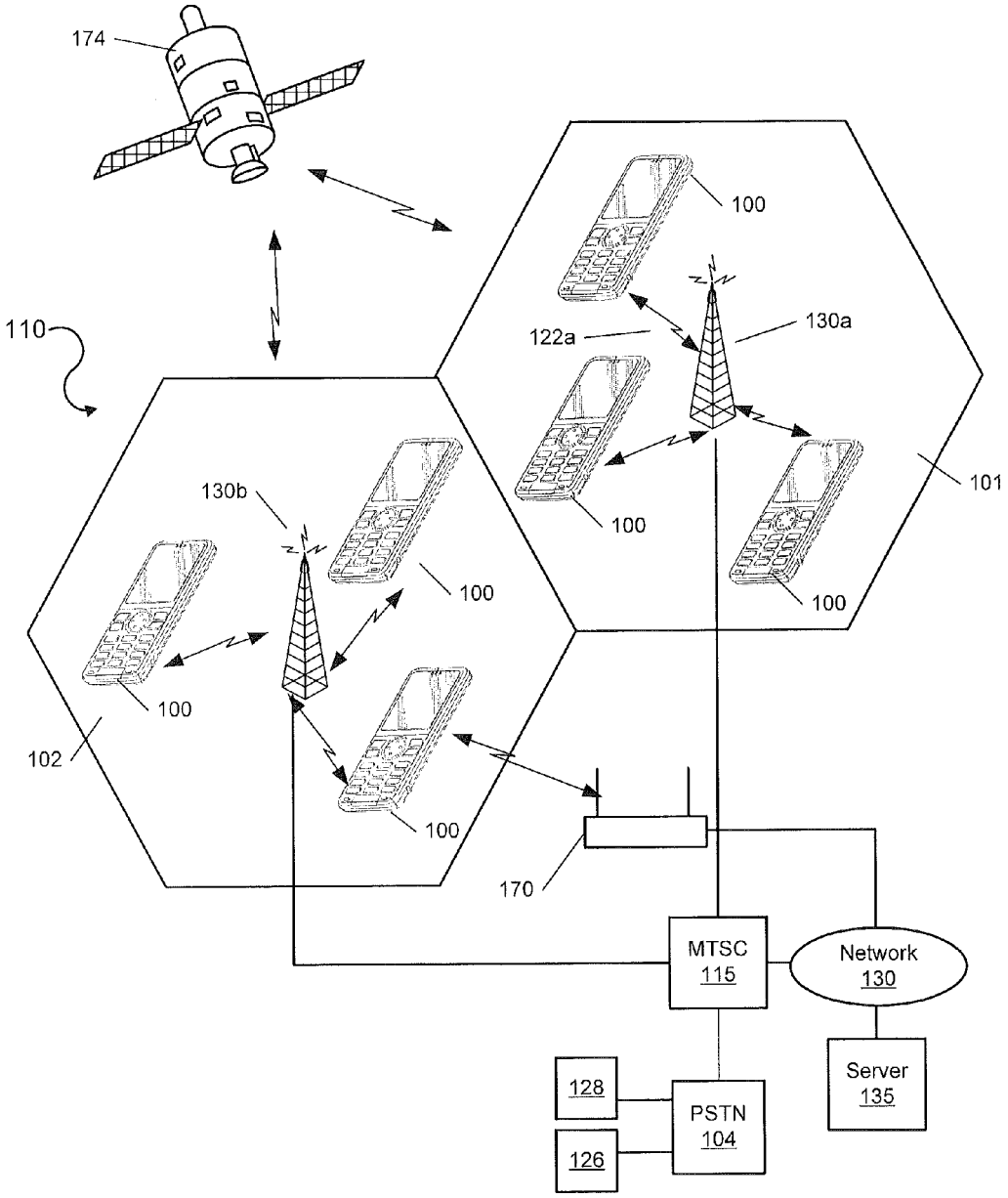
FIG. 1 is a schematic illustration of a wireless communications network that provides service to wireless electronic devices, according to various embodiments of the present inventive concepts.

The present inventive concepts now will be described more fully with reference to the accompanying drawings, in which embodiments of the inventive concepts are shown. However, the present application should not be construed as limited to the embodiments set forth herein. Rather, these embodiments are provided so that this disclosure will be thorough and complete, and to fully convey the scope of the embodiments to those skilled in the art. Like reference numbers refer to like elements throughout.

The terminology used herein is for the purpose of describing particular embodiments only and is not intended to be limiting of the embodiments. As used herein, the singular forms "a," "an," and "the" are intended to include the plural forms as well, unless the context clearly indicates otherwise. It will be further understood that the terms "comprises," "comprising," "includes," and/or "including," when used herein, specify the presence of stated features, steps, operations, elements, and/or components, but do not preclude the presence or addition of one or more other features, steps, operations, elements, components, and/or groups thereof.

It will be understood that when an element is referred to as being "coupled," "connected," or "responsive" to another element, it can be directly coupled, connected, or responsive to the other element, or intervening elements may also be present. In contrast, when an element is referred to as being "directly coupled," "directly connected," or "directly responsive" to another element, there are no intervening elements present. As used herein the term "and/or" includes any and all combinations of one or more of the associated listed items.

Spatially relative terms, such as "above", "below", "upper", "lower" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms first, second, etc. may be used herein to describe various elements, these elements should not be limited by these terms. These terms are only used to distinguish one element from another. Thus, a first element could be termed a second element without departing from the teachings of the present embodiments.

Unless otherwise defined, all terms (including technical and scientific terms) used herein have the same meaning as commonly understood by one of ordinary skill in the art to which these embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

For purposes of illustration and explanation only, various embodiments of the present inventive concepts are described herein in the context of "wireless electronic devices." Among other devices/systems, wireless electronic devices may include multi-band wireless communication terminals (e.g., portable electronic devices/wireless terminals/mobile terminals/terminals) that are configured to carry out cellular communications (e.g., cellular voice and/or data communications) in more than one frequency band. It will be understood, however, that the present inventive concepts are not limited to such embodiments and may be embodied generally in any device and/or system that is configured to transmit and receive in two or more frequency bands.

Various embodiments of the wireless electronic devices described herein may use antennas that form a partial ring adjacent a perimeter of a given wireless electronic device. For example, at least two antennas of a wireless electronic device may be curved antennas that conform to a shape or surface of the device housing or backplate. As an example, the curved antennas may be substantially L-shaped or hook-shaped. The curved antennas may thus each be non-planar antennas and may include one or more bends. For example, each curved antenna may include a bend having about a 90-degree angle. The curved antennas may each include a curved parasitic element and may be referred to as coupling feed ("C-fed") antennas. The curved antennas may additionally be referred to as "slot antennas." The curved antennas adjacent the perimeter of the wireless electronic device may be co-located (e.g., may be on the same end of the wireless electronic device) but also electrically isolated from each other, and may provide good performance characteristics such as low correlation and wide bandwidth.

Moreover, the wireless electronic device may further include a C-fed monopole antenna, in addition to the curved antennas. The C-fed monopole antenna may be incorporated while also providing wide bandwidth, good efficiency, and low correlation for the wireless electronic device.

Accordingly, the wireless electronic device may include curved antennas that form a partial ring adjacent a perimeter thereof. The curved antennas may provide good performance for the wireless electronic device and may be combined with a C-fed monopole antenna. Moreover, the wireless electronic device may provide desirable industrial design features such as a metal perimeter (e.g., metal edges/sides) and/or a metal backplate.

Referring to FIG. 1, a diagram is provided of a wireless communications network 110 that supports communications in which wireless electronic devices 100 can be used according to various embodiments of the present inventive concepts. The network 110 includes cells 101, 102 and base stations 130*a*, 130*b* in the respective cells 101, 102. Networks 110 are commonly employed to provide voice and data communications to subscribers using various radio access standards/technologies. The network 110 may include wireless electronic devices 100 that may communicate with the base stations 130*a*, 130*b*. The wireless electronic devices 100 in the network 110 may also communicate with a Global Positioning System (GPS) satellite 174, a local wireless network 170, a Mobile Telephone Switching Center (MTSC) 115, and/or a Public Service Telephone Network (PSTN) 104 (i.e., a "landline" network).

The wireless electronic devices 100 can communicate with each other via the Mobile Telephone Switching Center (MTSC) 115. The wireless electronic devices 100 can also communicate with other devices/terminals, such as terminals 126, 128, via the PSTN 104 that is coupled to the network 110. As also shown in FIG. 1, the MTSC 115 is coupled to a computer server 135 via a network 130, such as the Internet.

The network 110 is organized as cells 101, 102 that collectively can provide service to a broader geographic region. In particular, each of the cells 101, 102 can provide service to associated sub-regions (e.g., regions within the hexagonal areas illustrated by the cells 101, 102 in FIG. 1) included in the broader geographic region covered by the network 110. More or fewer cells can be included in the network 110, and the coverage area for the cells 101, 102 may overlap. The shape of the coverage area for each of the cells 101, 102 may be different from one cell to another and is not limited to the hexagonal shapes illustrated in FIG. 1. Each of the cells 101, 102 may include an associated base station 130*a*, 130*b*. The base stations 130*a*, 130*b* can provide wireless communications between each other and the wireless electronic devices 100 in the associated geographic region covered by the network 110.

Each of the base stations 130*a*, 130*b* can transmit/receive data to/from the wireless electronic devices 100 over an associated control channel. For example, the base station 130*a* in cell 101 can communicate with one of the wireless electronic devices 100 in cell 101 over the control channel 122*a*. The control channel 122*a* can be used, for example, to page the wireless electronic device 100 in response to calls directed thereto or to transmit traffic channel assignments to the wireless electronic device 100 over which a call associated therewith is to be conducted.

The wireless electronic devices 100 may also be capable of receiving messages from the network 110 over the respective control channels 122*a*. In various embodiments according to the inventive concepts, the wireless electronic devices 100 receive Short Message Service (SMS), Enhanced Message Service (EMS), Multimedia Message Service (MMS), and/or Smartmessaging™ formatted messages.

The GPS satellite 174 can provide GPS information to the geographic region including cells 101, 102 so that the wireless electronic devices 100 may determine location information. The network 110 may also provide network location information as the basis for the location information applied by the wireless electronic devices 100. In addition, the location information may be provided directly to the server 135 rather than to the wireless electronic devices 100 and then to the server 135. Additionally or alternatively, the wireless electronic devices 100 may communicate with the local wireless network 170.

Figure 2A:
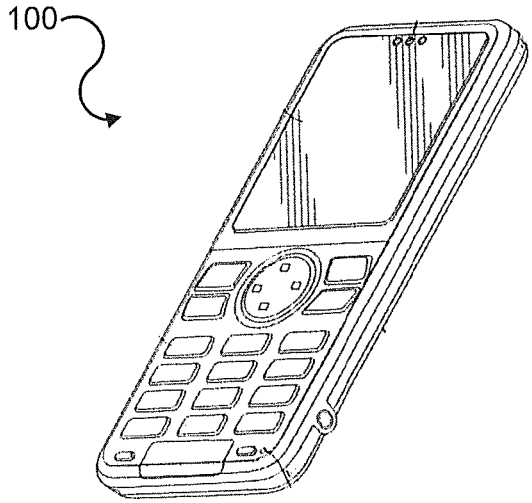
FIGS. 2A and 2B illustrate front and rear views, respectively, of a wireless electronic device, according to various embodiments of the present inventive concepts.
Figure 2B:
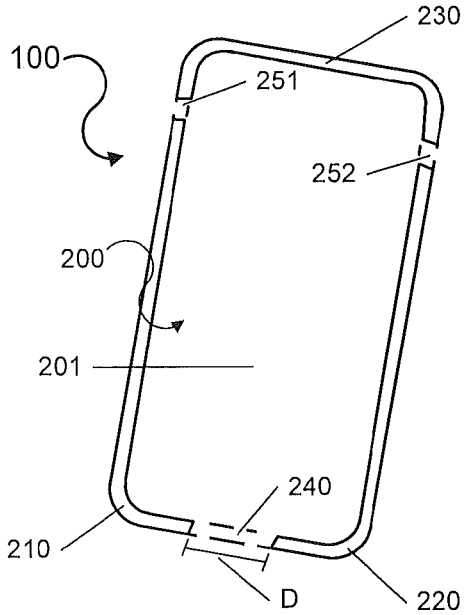

FIGS. 2A and 2B illustrate front and rear views, respectively, of a wireless electronic device 100, according to various embodiments of the present inventive concepts. Accordingly, FIGS. 2A and 2B illustrate opposite sides of the wireless electronic device 100. In particular, FIG. 2B illustrates an external face 201 of a backplate 200 of the wireless electronic device 100. Accordingly, the external face 201 of the backplate 200 may be visible to, and/or in contact with, a user of the wireless electronic device 100. In contrast, an internal face of the backplate 200 may face internal portions of the wireless electronic device 100, such as a transceiver circuit.

FIG. 2B further illustrates a first antenna 210 and a second antenna 220 on one end of the wireless electronic device 100, and a third antenna 230 on another end of the wireless electronic device 100. For example, one end may be the top end or the bottom end of the wireless electronic device 100, and the other end may be the other of the top end and the bottom end of the wireless electronic device 100. Moreover, it will be understood that the wireless electronic device 100 may include more than three antennas, and/or that the antennas 210, 220, 230 may include various types of antennas configured for wireless communications. For example, at least one of the antennas 210, 220, 230 may be a monopole antenna or a planar inverted-F antenna (PIFA), among others. Additionally, at least one of the antennas 210, 220, 230 may be a multi-band antenna and/or may be configured to communicate cellular and/or non-cellular frequencies.

Moreover, the backplate 200 of the wireless electronic device 100 may overlap/cover at least a portion of the antennas 210, 220, 230. In other words, at least a portion of the antennas 210, 220, 230 may be recessed within a perimeter of the external face 201 of the backplate 200, and may be between the external face 201 of the backplate 200 and a front external face (e.g., a display) of the wireless electronic device 100. Accordingly, although portions of the antennas 210, 220, 230 may be outside the perimeter of the external face 201 of the backplate 200 (e.g., as illustrated in the rear view of the wireless electronic device 100 provided in FIG. 2B), the antennas 210, 220, 230 may alternatively not be visible at all in the rear view of FIG. 2B or may be partially concealed by the external face 201 of the backplate 200.

Referring still to FIG. 2B, the first and second antennas 210 and 220 may be curved antennas. For example, each of the first and second antennas 210 and 220 may include a curve that corresponds with a curve (e.g., a corner) of the external face 201 of the backplate 200 of the wireless electronic device 100, or otherwise conforms to a shape or surface of the wireless electronic device 100. Accordingly, the first and second curved antennas 210 and 220 may form a partial ring along (e.g., adjacent) the perimeter of the backplate 200. Moreover, each of the first and second curved antennas 210 and 220 may extend along a majority of the respective side portion (e.g., the left side or the right side) of the backplate 200 of the wireless electronic device 100.

The first and second curved antennas 210 and 220 may be spaced apart from each other along one end portion of the backplate 200. A gap 240 between the first and second curved antennas 210 and 220 along the end portion of the backplate 200 may have a distance/length D of about 8.0 millimeters (mm) or greater (e.g., may range from about 8.0 mm to about 20.0 mm). The gap 240 provides physical and electrical isolation (e.g., to reduce coupling) between the first and second curved antennas 210 and 220. The gap 240 may be a void or may include a dielectric/insulative material. Additionally or alternatively, the gap 240 may include a connector that is configured to provide at least one of power, audio, video, and Universal Serial Bus (USB) connections.

The third antenna 230 may be separated from the first and second curved antennas 210 and 220 along the perimeter of the backplate 200 of the wireless electronic device 100 by gaps 251 and 252, respectively. The gaps 251 and 252 may be smaller than the gap 240. For example, the gaps 251 and 252 may each be about 1.0 mm along respective sides/edges of the wireless electronic device 100. The gaps 251 and 252 may be voids or may include a dielectric/insulative material.

In some embodiments of the present inventive concepts, the third antenna 230 may be a curved antenna. For example, the third curved antenna 230 may include at least one curve that corresponds with a curve (e.g., a corner) of the external face 201 of the backplate 200 of the wireless electronic device 100, or otherwise conforms to a shape or surface of the wireless electronic device 100. As an example, the third curved antenna 230 may include two curves corresponding to two respective corners of the wireless electronic device 100. Accordingly, the first, second, and third curved antennas 210, 220, and 230 may include curves corresponding to (e.g., along/adjacent) four corners of the wireless electronic device 100. The first, second, and third curved antennas 210, 220, and 230 may thus provide a partial ring along the perimeter of the backplate 200 of the wireless electronic device 100. The partial ring may be continuous (e.g., continuous metal) along the perimeter of the backplate 200 except for the gaps 240, 251, and 251.

The third curved antenna 230 may be a non-cellular antenna that is configured for applications such as Global Positioning System (GPS), Wireless Local Area Network (WLAN) (e.g., 802.11), or Bluetooth. The first and second curved antennas 210 and 220, on the other hand, may be cellular (e.g., LTE) antennas. It will be understood, however, that the third curved antenna 230 may alternatively be a cellular antenna, and that one of the first and second curved antennas 210 and 220 may be a non-cellular antenna. Moreover, the wireless electronic device 100 may be configured to select (e.g., using antenna swapping/switching techniques) one or more of the first, second, and third curved antennas 210, 220, and 230 for cellular communications. For example, the wireless electronic device 100 may determine that the second curved antenna 220 will provide stronger signal qualities than the first curved antenna 210, and may therefore select the second curved antenna 220 for cellular communications.

Figure 3:
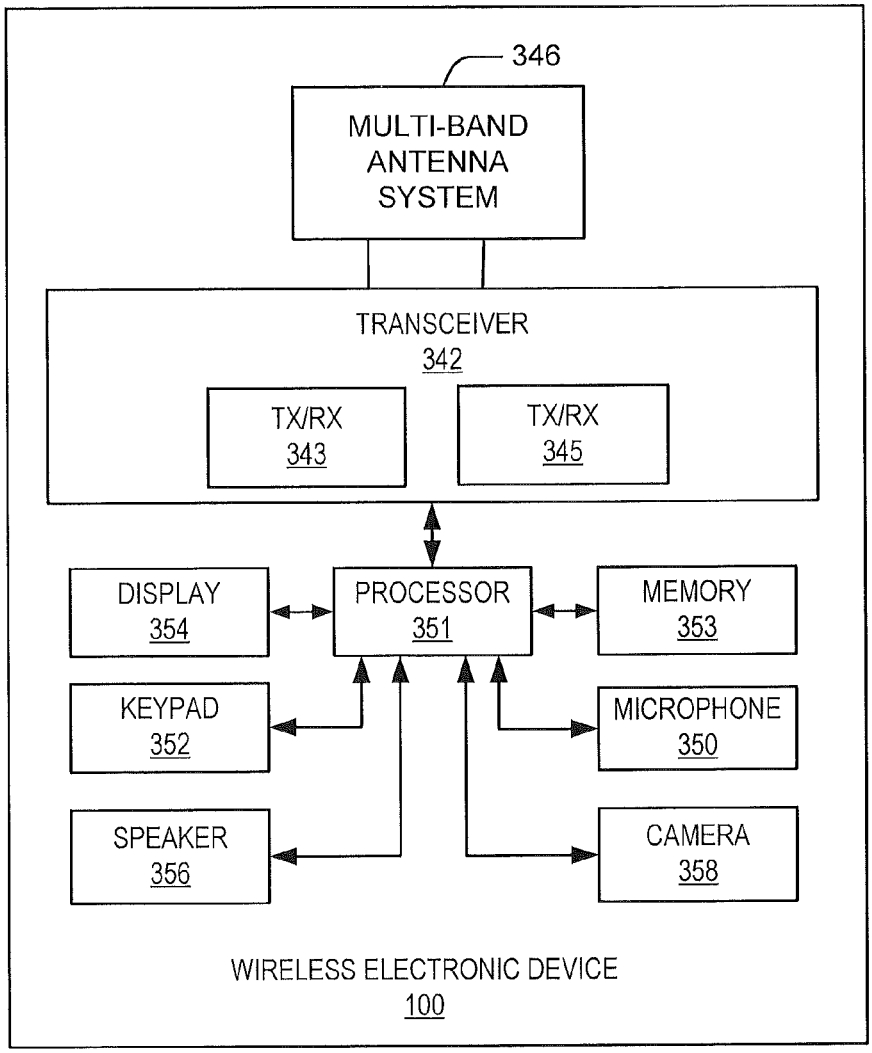
FIG. 3 is a block diagram illustrating a wireless electronic device, according to various embodiments of the present inventive concepts.

Referring now to FIG. 3, a block diagram is provided illustrating a wireless electronic device 100, according to various embodiments of the present inventive concepts. As illustrated in FIG. 3, a wireless electronic device 100 may include a multi-band antenna system 346, a transceiver 342, and a processor 351. The wireless electronic device 100 may further include a display 354, keypad 352, speaker 356, memory 353, microphone 350, and/or camera 358.

A transmitter portion of transceiver 342 converts information, which is to be transmitted by the wireless electronic device 100, into electromagnetic signals suitable for radio communications (e.g., to the network 110 illustrated in FIG. 1). A receiver portion of the transceiver 342 demodulates electromagnetic signals, which are received by the wireless electronic device 100 from the network 110 to provide the information contained in the signals in a format understandable to a user of the wireless electronic device 100. The transceiver 342 may include transmit/receive circuitry (TX/RX) that provides separate communication paths for supplying/receiving RF signals to different radiating elements of the multi-band antenna system 346 via their respective RF feeds. Accordingly, when the multi-band antenna system 346 includes two active antenna elements (e.g., the antennas 210, 220), the transceiver 342 may include two transmit/receive circuits 343, 345 connected to different ones of the antenna elements via the respective RF feeds.

The transceiver 342, in operational cooperation with the processor 351, may be configured to communicate according to at least one radio access technology in two or more frequency ranges. The at least one radio access technology may include, but is not limited to, WLAN (e.g., 802.11), WiMAX (Worldwide Interoperability for Microwave Access), TransferJet, 3GPP LTE (3rd Generation Partnership Project Long Term Evolution), 4G, Time Division LTE (TD LTE), Universal Mobile Telecommunications System (UMTS), Global Standard for Mobile (GSM) communication, General Packet Radio Service (GPRS), enhanced data rates for GSM evolution (EDGE), DCS, PDC, PCS, Code Division Multiple Access (CDMA), wideband-CDMA, and/or CDMA2000. The radio access technology may operate using such frequency bands as 700-800 Megahertz (MHz), 824-894 MHz, 880-960 MHz, 1710-1880 MHz, 1820-1990 MHz, 1920-2170 MHz, 2300-2400 MHz, and 2500-2700 MHz. Other radio access technologies and/or frequency bands can also be used in embodiments according to the inventive concepts. Various embodiments may provide coverage for non-cellular frequency bands such as Global Positioning System (GPS), WLAN, and/or Bluetooth frequency bands. As an example, in various embodiments according to the inventive concepts, the local wireless network 170 (illustrated in FIG. 1) is a WLAN compliant network. In various other embodiments according to the inventive concepts, the local wireless network 170 is a Bluetooth compliant interface.

The wireless electronic device 100 is not limited to any particular combination/arrangement of the keypad 352 and the display 354. As an example, it will be understood that the functions of the keypad 352 and the display 354 can be provided by a touch screen through which the user can view information, such as computer displayable documents, provide input thereto, and otherwise control the wireless electronic device 100. Additionally or alternatively, the wireless electronic device 100 may include a separate keypad 352 and display 354. Moreover, it will be understood that the first and second curved antennas 210 and 220 may substantially provide the sides/edges of the wireless electronic device 100 between the backplate 200 and the display 354.

Referring still to FIG. 3, the memory 353 can store computer program instructions that, when executed by the processor circuit 351, carry out the operations (e.g., antenna selection) described herein and shown in the figures. As an example, the memory 353 can be non-volatile memory, such as EEPROM (flash memory), that retains the stored data while power is removed from the memory 353.

Figure 4A:
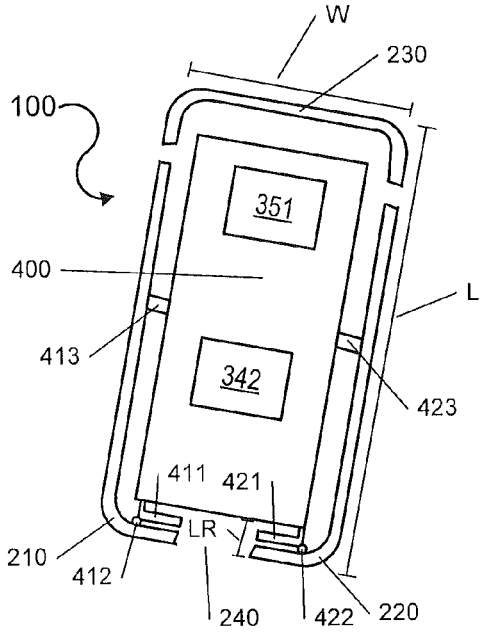
FIGS. 4A and 4B illustrate detailed views of antennas of a wireless electronic device, according to various embodiments of the present inventive concepts.
Figure 4B:
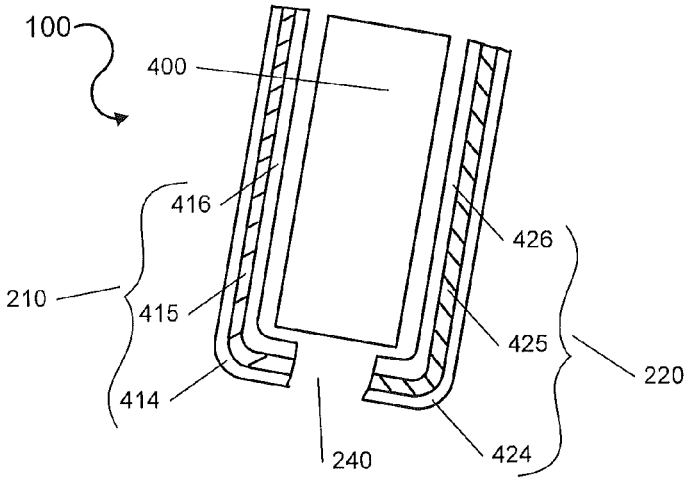

Referring now to FIGS. 4A and 4B, detailed views of antennas of a wireless electronic device 100 are illustrated, according to various embodiments of the present inventive concepts. For example, FIG. 4A illustrates a printed wiring board 400 (e.g., a printed circuit board) between the first, second, and third curved antennas 210, 220, and 230. The printed wiring board 400 may include various components of the wireless electronic device 100, such as the transceiver 342, the processor, 351, and/or the memory 353. Moreover, the printed wiring board 400 may be electrically/physically connected to exciting/feeding elements 411 and 421 for the first and second curved antennas 210 and 220, respectively. The exciting/feeding elements 411 and 421 may be connected to capacitive feeding elements 412 and 422, respectively.

Loading/grounding elements 413 and 423 (e.g., inductor loading/grounding elements) may be between the printed wiring board 400 and the first and second curved antennas 210 and 220, respectively. For example, the loading/grounding elements 413 and 423 may be adjacent respective sides/edges of the wireless electronic device 100, which may reduce interference that might otherwise be caused by a user of the wireless electronic device 100 touching the wireless electronic device 100 at one of the sides/edges. In other words, grounding each of the first and second curved antennas 210 and 220 at a side/edge of the wireless electronic device 100 (e.g., adjacent a side portion of the backplate 200 and the printed wiring board 400) may allow a user to touch the first and/or second curved antennas 210 and 220 at the sides/edges without causing substantial interference.

Referring still to FIG. 4A, the wireless electronic device 100 may have a length L of about 130.0 mm. Also, the length LR from the printed wiring board 400 to the outer edge of the first curved antenna 210 or the second curved antenna 220 along one end of the wireless electronic device 100 may be about 10.0 mm. Accordingly, the distance from the printed wiring board 400 to the other end of the wireless electronic device 100 may be about 120.0 mm (i.e., 130.0 mm minus 10.0 mm). Moreover, the width W of the wireless electronic device 100 (e.g., the distance from an outer edge of the first curved antenna 210 to an outer edge of the second curved antenna 220 along sides/edges of the wireless electronic device 100) may be about 66.0 mm. It will be understood, however, that the dimensions of the wireless electronic device 100 may be larger or smaller than those described in examples herein. Additionally, if the third antenna 230 includes two curved portions, then the width W may be the width of the third curved antenna 230.

Referring to FIG. 4B, each cellular (e.g., LTE) antenna may include a parasitic element electrically coupled to a co-located radiating element. For example, the first and second curved antennas 210 and 220 may include parasitic elements 414 and 424 coupled to radiating elements 416 and 426, respectively. The parasitic elements 414 and 424 and the radiating elements 416 and 426 may each include a metal. In particular, each of the parasitic elements 414 and 424 may provide a partial metal ring that extends adjacent a perimeter of the backplate 200 from the end portion of the backplate 200 with the gap 240 to a respective side portion of the backplate 200.

Each of the parasitic elements 414 and 424 may provide an outer partial metal ring and each of the radiating elements 416 and 426 may provide an inner partial metal ring, such that a distance between each of the parasitic elements 414 and 424 and the printed wiring board 400 (e.g., the transceiver 342) is greater than a distance between each of the radiating elements 416 and 426 and the printed wiring board 400. Moreover, the parasitic elements 414 and 424 may be on frames/carriers 415 and 425 (which are illustrated as cross-hatched in FIG. 4B), respectively. Each of the frames/carriers 415 and 425 may include a dielectric material (e.g., plastic, glass, and/or ceramic). Although the frames/carriers 415 and 425 may separate the parasitic elements 414 and 424 from the respective radiating elements 416 and 426 and the backplate 200, it will be understood that the parasitic elements 414 and 424, the frames/carriers 415 and 425, and the radiating elements 416 and 426 may have different lengths along the perimeter of the wireless electronic device 100. For example, the radiating elements 416 and 426 may only be at the end of the wireless electronic device 100 having the gap 240, whereas the parasitic elements 414 and 424 may extend adjacent the perimeter of the backplate 200 from the end of the wireless electronic device 100 having the gap 240 to/along respective side portions of the backplate 200.

The first and second curved antennas 210 and 220 may be various types of antennas. For example, if the first curved antenna 210 includes only one grounding point (e.g., the loading/grounding element 413 along the side/edge of the wireless electronic device 100) adjacent the backplate 200 and the printed wiring board 400, then the first curved antenna 210 may be a quarter-wave parasitic antenna. Alternatively, the first curved antenna 210 may be a half-wave parasitic antenna.

Figure 5:
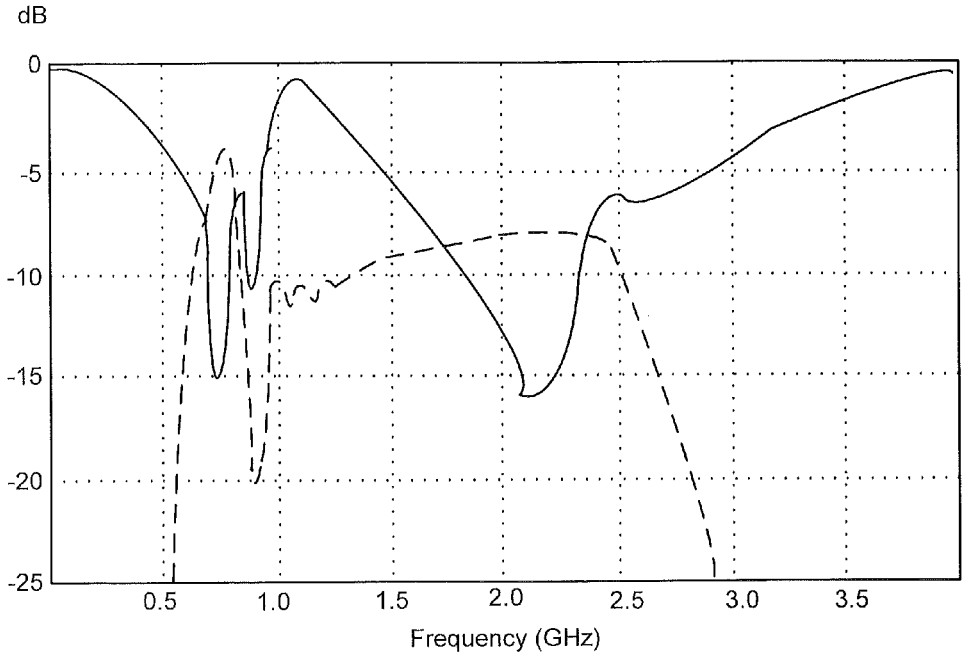
FIG. 5 illustrates operational bandwidths of antennas of a wireless electronic device, according to various embodiments of the present inventive concepts.

Referring now to FIG. 5, operational bandwidths of antennas of a wireless electronic device 100 are illustrated, according to various embodiments of the present inventive concepts. Specifically, FIG. 5 illustrates S-parameters for the first and second curved antennas 210 and 220. In particular, FIG. 5 illustrates that the first and second curved antennas 210 and 220 including parasitic elements 414 and 424 coupled to co-located radiating elements 416 and 426, respectively, provide coverage across a wide frequency bandwidth. For example, FIG. 5 illustrates results for the first and second curved antennas 210 and 220 between about −1 dB and −20 dB for a low band (e.g., about 760 MHz-960 MHz) and for a high band (e.g., about 1.7 GHz-2.7 GHz).

Figure 6:
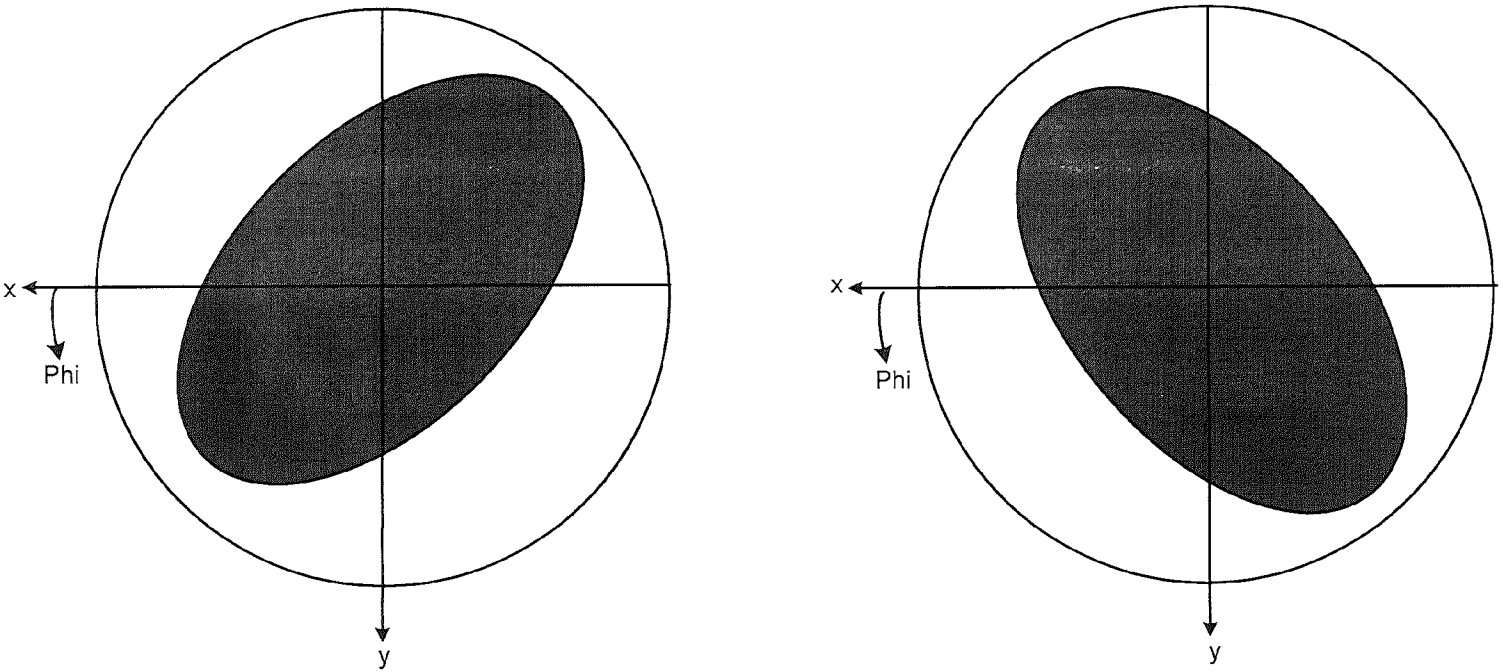
FIG. 6 illustrates radiation patterns for antennas of a wireless electronic device, according to various embodiments of the present inventive concepts.

Referring now to FIG. 6, radiation patterns for antennas of a wireless electronic device 100 are illustrated, according to various embodiments of the present inventive concepts. In particular, FIG. 6 illustrates radiation patterns for the first and second curved antennas 210 and 220 including parasitic elements 414 and 424 coupled to co-located radiating elements 416 and 426, respectively, at a low band frequency of about 860 MHz. As the radiation patterns for the first and second curved antennas 210 and 220 are different (e.g., substantially opposite/mirror images) from each other, this indicates that the radiation patterns have been separated effectively. Accordingly, the radiation patterns of FIG. 6 indicate good isolation (e.g., low correlation) between the first and second curved antennas 210 and 220 (e.g., LTE antennas).

Figure 7:
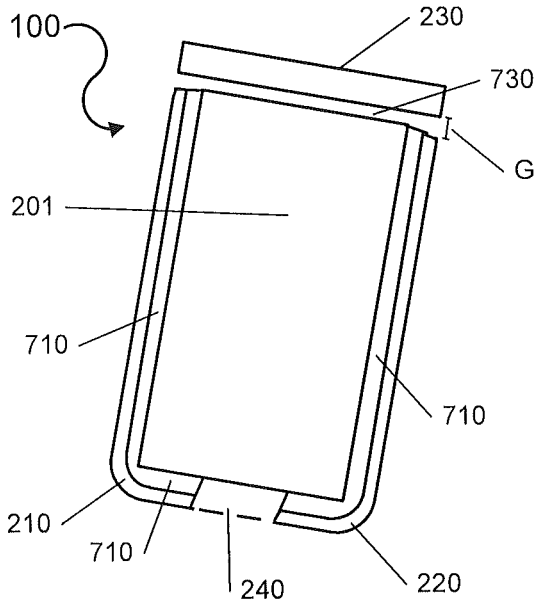
FIG. 7 illustrates a wireless electronic device including a third antenna, according to various embodiments of the present inventive concepts.

Referring now to FIG. 7, a wireless electronic device 100 including a third antenna 230 is illustrated, according to various embodiments of the present inventive concepts. In particular, FIG. 7 illustrates that the third antenna 230 is separated from the backplate 200 (e.g., an end of the backplate 200) of the wireless electronic device 100 by a gap 730, which includes a distance G. The third antenna 230 may be at least one of a curved antenna, a cellular antenna, a non-cellular antenna, a diversity antenna, and a C-fed monopole metal antenna. For example, the external face 201 of the backplate 200 may be metal and the third antenna 230 may include a metal (e.g., a metal plate) that is electrically coupled to the metal backplate 200 to provide a C-fed monopole metal (e.g., metal plate) antenna. As an example, the first curved antenna 210 may be a cellular antenna, the second curved antenna 220 may be a non-cellular antenna, and the third antenna 230 may provide a C-fed monopole metal antenna that is a diversity antenna. Alternatively, the third antenna 230 may be a primary/main cellular antenna, whereas the first curved antenna 210 may be a diversity antenna and the second curved antenna 220 may be a non-cellular antenna. Furthermore, it will be understood that the third antenna 230 in FIG. 7 may be a curved antenna, which may also be a cellular antenna (e.g., a main/primary cellular antenna) or a non-cellular antenna. For example, the first, second, and third antennas 210, 220, and 230 may each be partial metal ring antennas.

In some embodiments according to the present inventive concepts, the third antenna may have a dielectric (e.g., plastic) cover. Moreover, the backplate 200 of the wireless electronic device 100 may be metal or dielectric (e.g., plastic). Additionally, the gap 730 may provide physical and electrical isolation between the third antenna 230 and the first and second curved antennas 210 and 220. The gap 730 may also provide physical and electrical isolation (e.g., separation) between the third antenna 230 and the backplate 200 of the wireless electronic device 100. The gap 730 may be a void or may include a dielectric/insulative material. Additionally, the gap 730 may be substantially transparent.

Referring still to FIG. 7, a dielectric frame/carrier 710 may be between the first and second curved antennas 210 and 220 and the backplate 200 of the wireless electronic device 100. The dielectric frame/carrier 710 may include plastic, glass, and/or ceramic materials. Additionally, the dielectric frame/carrier 710 may provide a slot between the backplate 200 of the wireless electronic device 100 and the display 354. The dielectric frame/carrier may 710 be substantially contiguous or may be divided (e.g., divided similarly to the frames/carriers 415 and 425 illustrated in FIG. 4B) by the gap 240. Moreover, although FIG. 7 illustrates the dielectric frame/carrier 710 between the first and second curved antennas 210 and 220 and the backplate 200 of the wireless electronic device 100, the first and second curved antennas 210 and 220 may include respective parasitic elements and respective radiating elements that are on the same side of the dielectric frame 710 or, alternatively, that are separated (e.g., similarly to the separation of the radiating elements 416 and 426 from the parasitic elements 414 and 424 in FIG. 4B) by the dielectric frame 710.

Figure 8:
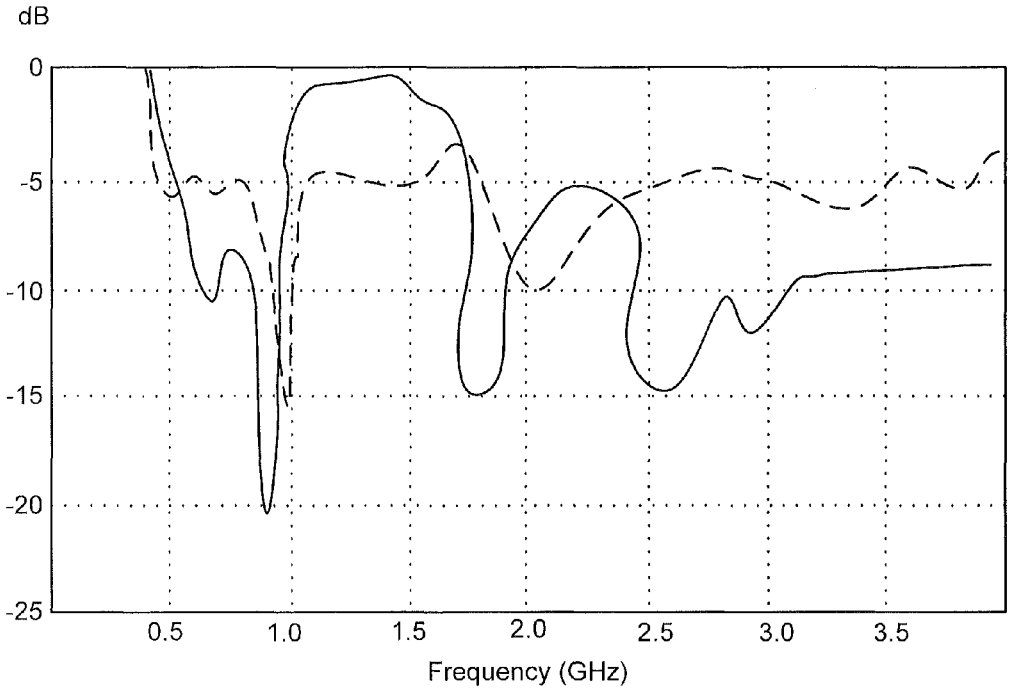
FIG. 8 illustrates S-parameters of antennas of a wireless electronic device including a third antenna, according to various embodiments of the present inventive concepts.

Referring now to FIG. 8, S-parameters of antennas of a wireless electronic device 100 including a third antenna 230 are illustrated, according to various embodiments of the present inventive concepts. In particular, FIG. 8 illustrates S-parameters of the third antenna 230 illustrated in FIG. 7 and one of the first and second curved antennas 210 and 220. Specifically, the continuous curve in FIG. 8 indicates the third antenna 230 as a monopole antenna, and the broken curve in FIG. 8 illustrates one of the first and second curved antennas 210 and 220. The curves in FIG. 8 illustrate that the wireless electronic device 100 including the third antenna 230 as a monopole antenna provides coverage across a wide frequency bandwidth.

Figure 9:
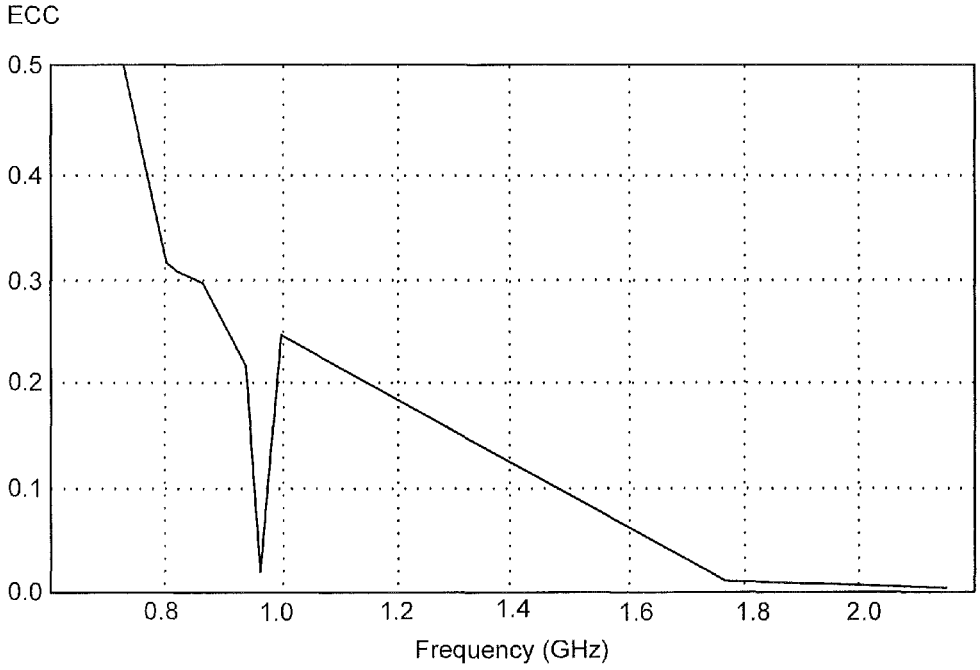
FIG. 9 illustrates antenna correlation for a wireless electronic device including a third antenna, according to various embodiments of the present inventive concepts.

Referring now to FIG. 9, antenna correlation for a wireless electronic device 100 including a third antenna 230 is illustrated, according to various embodiments of the present inventive concepts. In particular, FIG. 9 illustrates envelope correlation coefficients (ECCs) (e.g., the real part of correlation) for the third antenna 230 illustrated in FIG. 7 and one of the first and second curved antennas 210 and 220. Specifically, FIG. 9 illustrates low correlation (e.g., lower than about 0.3 for most frequencies) between the third antenna 230 as a monopole antenna and one of the first and second curved antennas 210 and 220, for a wide frequency band. Accordingly, the combination of FIG. 7's third antenna 230 as a monopole antenna with the first and second curved antennas 210 and 220 provides good isolation between the antennas at all frequencies.

Figure 10:
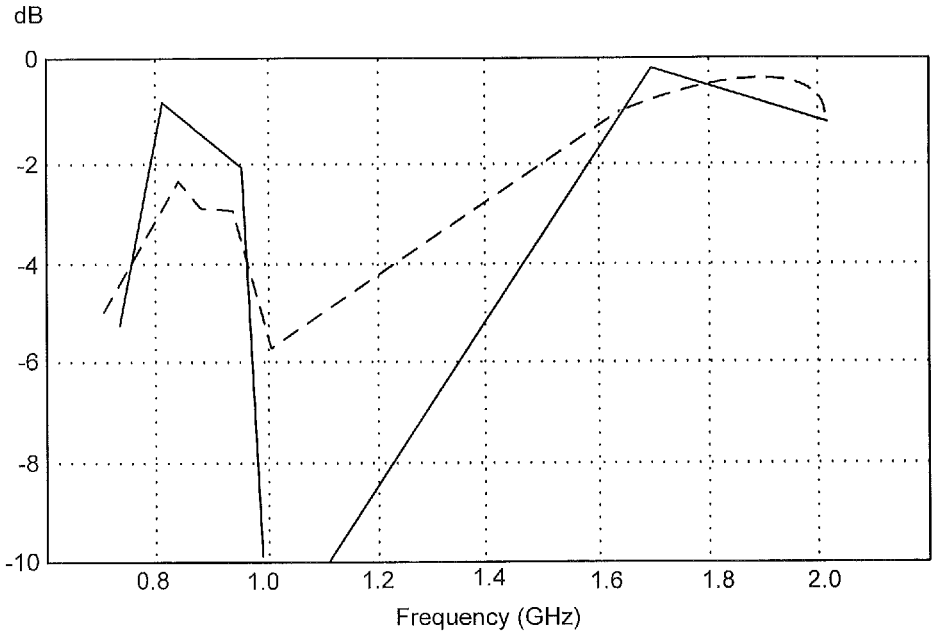
FIG. 10 illustrates antenna efficiency for a wireless electronic device including a third antenna, according to various embodiments of the present inventive concepts.

Referring now to FIG. 10, antenna efficiency for a wireless electronic device 100 including a third antenna 230 is illustrated, according to various embodiments of the present inventive concepts. In particular, FIG. 10 illustrates efficiency measurements (e.g., the real part of efficiency) with respect to the third antenna 230 illustrated in FIG. 7 and one of the first and second curved antennas 210 and 220. Specifically, FIG. 10 illustrates high efficiency (e.g., better than about −4 dB for most frequencies) for the third antenna 230 as a monopole antenna and one of the first and second curved antennas 210 and 220. Accordingly, the combination of FIG. 7's third antenna 230 as a monopole antenna with the first and second curved antennas 210 and 220 provides good efficiency for the antennas at a wide range of frequencies.

Many different embodiments have been disclosed herein, in connection with the above description and the drawings. It will be understood that it would be unduly repetitious and obfuscating to literally describe and illustrate every combination and subcombination of these embodiments. Accordingly, the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed various embodiments and, although specific terms are employed, they are used in a generic and descriptive sense only and not for purposes of limitation.

What is claimed is:

1. A wireless electronic device, comprising:

a backplate;

first and second curved antennas spaced apart from each other along an end portion of the backplate, each of the first and second curved antennas comprising a radiating element and a parasitic element electrically coupled to the radiating element; and a printed wiring board spaced apart from the first and second curved antennas.

2. The wireless electronic device of claim 1, wherein each parasitic element comprises a respective partial metal ring that extends adjacent a perimeter of the backplate from the end portion of the backplate to a respective side portion of the backplate.

3. The wireless electronic device of claim 2, further comprising a multi-band transceiver circuit coupled to the first and second curved antennas and configured to provide communications for the wireless electronic device via a plurality of frequency bands, wherein a distance between each partial metal ring and the multi-band transceiver circuit is greater than a distance between each radiating element and the multi-band transceiver circuit.

4. The wireless electronic device of claim 3, wherein each partial metal ring is on a respective dielectric frame that is between the partial metal ring and the backplate.

5. The wireless electronic device of claim 4, wherein each dielectric frame comprises at least one of plastic, glass, and ceramic materials.

6. The wireless electronic device of claim 2, wherein each of the first and second curved antennas extends along a majority of the respective side portion of the backplate.

7. The wireless electronic device of claim 2, wherein each of the first and second curved antennas is grounded adjacent the respective side portion of the backplate.

8. The wireless electronic device of claim 1, wherein the first and second curved antennas are spaced apart from each other along the end portion of the backplate to provide a gap between the first and second curved antennas of about 8.0 millimeters.

9. The wireless electronic device of claim 8, further comprising a connector in the gap that is configured to provide at least one of power, audio, video, and Universal Serial Bus (USB) connections.

10. The wireless electronic device of claim 1, further comprising a third antenna on another end portion of the backplate.

11. The wireless electronic device of claim 10, wherein the third antenna comprises at least one of a curved antenna, a cellular antenna, a non-cellular antenna, a diversity antenna, and a C-fed monopole metal antenna.

12. The wireless electronic device of claim 11, further comprising a gap that separates the third antenna from the backplate and the first and second curved antennas.

13. The wireless electronic device of claim 12, wherein:

the third antenna comprises a cellular antenna; and the first and second curved antennas comprise a non-cellular antenna and a cellular antenna, respectively.

14. The wireless electronic device of claim 11, wherein:

the third antenna comprises a non-cellular antenna; and the first and second curved antennas comprise respective cellular antennas.

15. The wireless electronic device of claim 11, wherein the first, second, and third antennas comprise respective partial metal ring antennas.

16. The wireless electronic device of claim 11, wherein the backplate comprises a metal backplate.

17. A wireless electronic device, comprising:

a printed wiring board;

a backplate;

a multi-band transceiver circuit on the printed wiring board and configured to provide communications for the wireless electronic device via a plurality of frequency bands; and first and second curved antennas spaced apart from each other along an end portion of the backplate, each of the first and second curved antennas comprising a radiating element and a parasitic element electrically coupled to the radiating element, wherein the multi-band transceiver circuit is configured to communicate through the first and second curved antennas via the plurality of frequency bands, wherein each parasitic element comprises a respective partial metal ring that extends from the end portion of the backplate to a respective side portion of the backplate, wherein each of the first and second curved antennas extends along a majority of the respective side portion of the backplate, and wherein the printed wiring board is spaced apart from the first and second curved antennas.

18. The wireless electronic device of claim 17, wherein each of the first and second curved antennas is grounded adjacent the respective side portion of the backplate, wherein the backplate comprises an external face that is touchable by a user of the wireless electronic device, and wherein the first and second curved antennas define respective external edges of the wireless electronic device that are touchable by the user.

19. A multi-band antenna system, comprising:

a backplate comprising a perimeter that includes first and second end portions and first and second side portions;

first and second metal curved antennas spaced apart from each other along the first end portion of the backplate, each of the first and second metal curved antennas comprising respective first and second radiating elements electrically coupled to respective first and second metal curved parasitic elements, wherein each of the first and second metal curved parasitic elements extends continuously adjacent the perimeter from the end portion of the backplate along a respective one of the first and second side portions of the backplate; and a printed wiring board spaced apart from the first and second metal curved antennas.

20. The multi-band antenna system of claim 19, further comprising a third antenna on the second end portion of the backplate, wherein:

the first and second metal curved antennas are grounded adjacent the respective first and second side portions of the backplate;

the third antenna comprises a monopole antenna;

the first and second curved antennas comprise a non-cellular antenna and a cellular antenna, respectively; and the first and second metal curved parasitic elements extend continuously adjacent the perimeter from the end portion of the backplate along a majority of the first and second side portions of the backplate, respectively.

* * * * *